US008726560B2

(12) United States Patent
Overstreet et al.

(10) Patent No.: US 8,726,560 B2
(45) Date of Patent: May 20, 2014

(54) CHAMBER INSERT LOCK INSTALLED WITHIN AN AR-15/16 BARREL EXTENSION FOR LOCATING AND REDUCING MOVEMENT OF AN ASSOCIATED SUB CALIBER ACTION

(75) Inventors: John L. Overstreet, Fayette, MO (US); Charles C. Kelly, Kirksville, MO (US); Jordan Bowles, Columbia, MO (US); Tyson Bradshaw, Kirksville, MO (US); Craig Pudil, Boonville, MO (US); Taz B. Pfefer, Ashland, MO (US)

(73) Assignee: 22 Evolution LLC, Columbia, MO (US)

( * ) Notice: Subject to any disclaimer, the term of this patent is extended or adjusted under 35 U.S.C. 154(b) by 548 days.

(21) Appl. No.: 13/070,023

(22) Filed: Mar. 23, 2011

(65) Prior Publication Data

US 2011/0265638 A1 Nov. 3, 2011

Related U.S. Application Data

(60) Provisional application No. 61/328,765, filed on Apr. 28, 2010.

(51) Int. Cl.
*F41A 21/10* (2006.01)

(52) U.S. Cl.
USPC ..... 42/77; 42/69.02; 89/128

(58) Field of Classification Search
USPC ..... 42/77, 106, 69.02, 14; 89/29
See application file for complete search history.

(56) References Cited

U.S. PATENT DOCUMENTS 3,776,095 A * 12/1973 Atchisson ..... 89/128
4,069,608 A * 1/1978 Jurek ..... 42/49.02
4,098,016 A * 7/1978 Foote ..... 42/16
4,169,329 A * 10/1979 Atchisson ..... 42/16
4,194,314 A 3/1980 Foote
4,617,749 A * 10/1986 Jurek ..... 42/16
4,955,157 A * 9/1990 Brighton et al. ..... 42/77
6,050,170 A * 4/2000 Guiette et al. ..... 89/29
6,293,040 B1 * 9/2001 Luth ..... 42/75.01
7,059,076 B2 6/2006 Stoner et al.
7,302,881 B1 * 12/2007 Tertin ..... 89/128
7,444,775 B1 * 11/2008 Schuetz ..... 42/76.01
7,798,045 B1 9/2010 Fitzpatrick et al.
7,849,777 B1 12/2010 Zedrosser
8,316,755 B2 * 11/2012 Overstreet et al. ..... 89/179
8,397,416 B2 * 3/2013 Laney et al. ..... 42/75.02
8,453,367 B2 * 6/2013 Overstreet et al. ..... 42/108
8,505,428 B2 * 8/2013 Overstreet et al. ..... 89/1.4
8,590,199 B2 * 11/2013 Overstreet et al. ..... 42/69.02
2007/0277669 A1 * 12/2007 Tertin ..... 89/128
2008/0302235 A1 12/2008 Lauck
2011/0252685 A1 * 10/2011 Overstreet et al. ..... 42/16

(Continued)

*Primary Examiner* — Benjamin P Lee

(74) *Attorney, Agent, or Firm* — Gifford, Krass, Sprinkle, Anderson & Citkowski, P.C.; Douglas J. McEvoy

(57) ABSTRACT

The present invention teaches an insert locking mechanism incorporated into a sub caliber action device, installable within an upper receiver of an AR-15 type firearm, and which interfaces with an upper receiver mounted forward assist for use with such as .22 caliber ammunition and in order to eliminate movement or play of the chamber insert adaptor associated with the substituted sub caliber action. The mechanism includes a generally cylindrical shaped body supported upon the action and exhibiting a plurality of radially projecting and circumferentially extending lugs which are configured to mate and seat within a plurality of grooves circumferentially arrayed within a barrel defined in the upper receiver.

13 Claims, 10 Drawing Sheets

(56) References Cited

U.S. PATENT DOCUMENTS

2011/0252957 A1* 10/2011 Overstreet et al. ..... 89/128
2011/0277368 A1* 11/2011 Overstreet et al. ..... 42/108
2012/0005931 A1* 1/2012 Kelly et al. ..... 42/14

* cited by examiner

FIG. 8
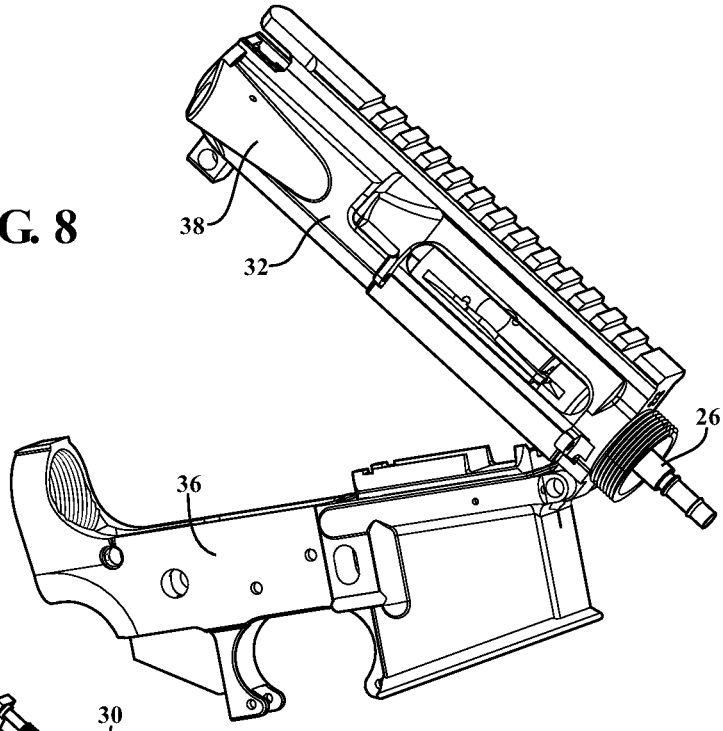
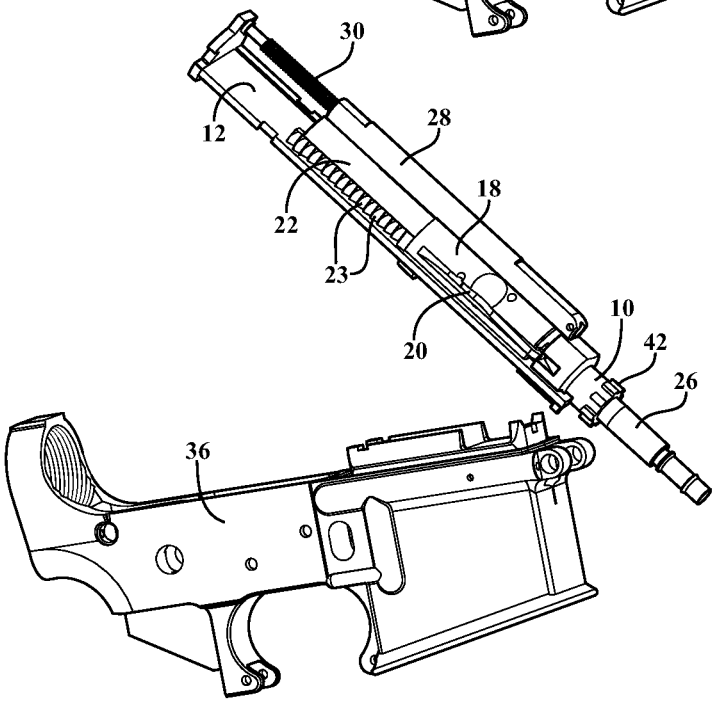
FIG. 9

FIG. 14
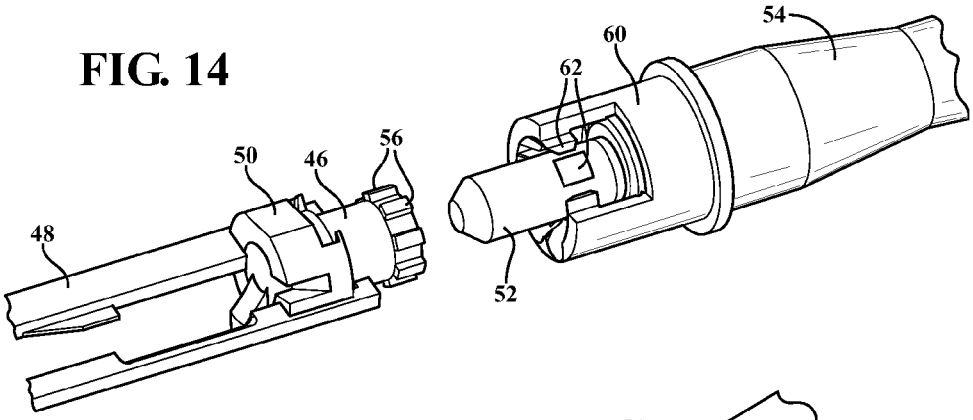
FIG. 15
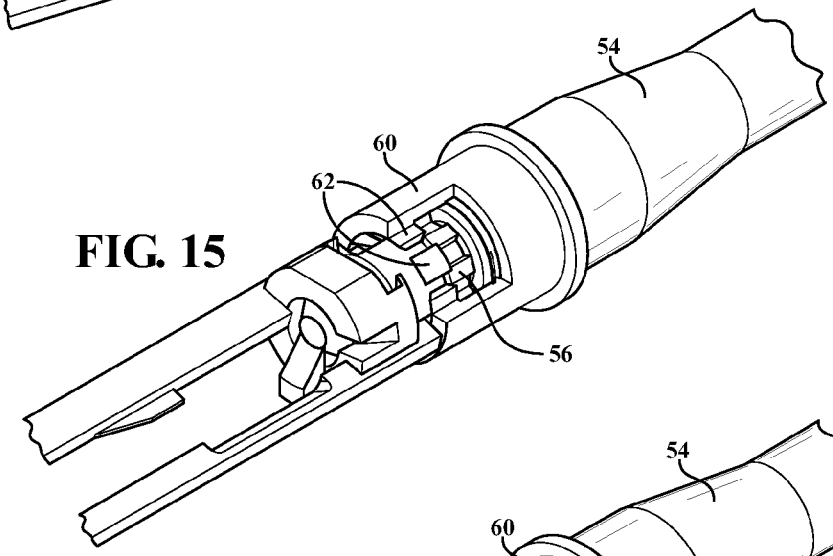
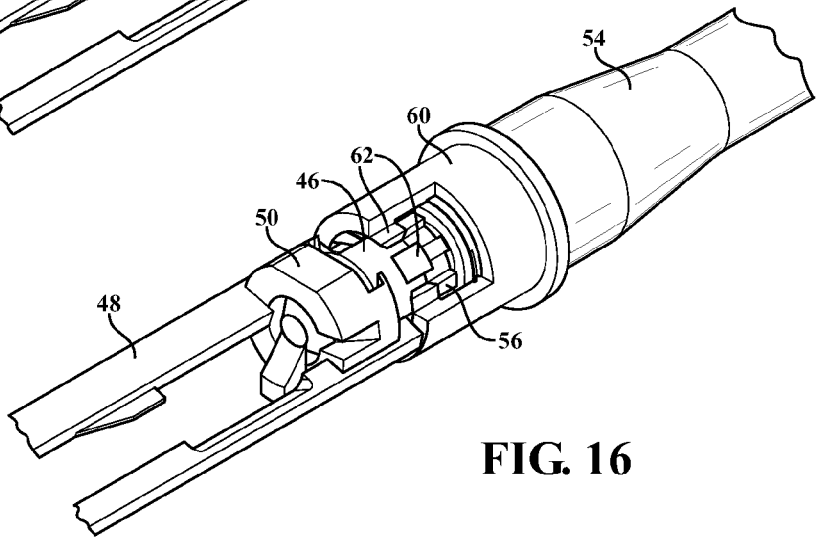
FIG. 16

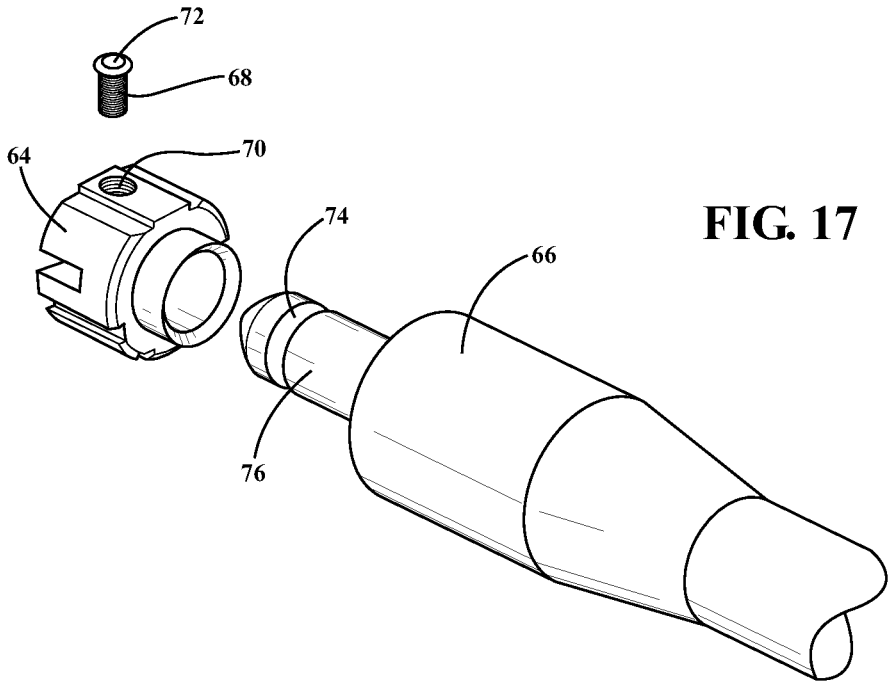
FIG. 17
FIG. 17A
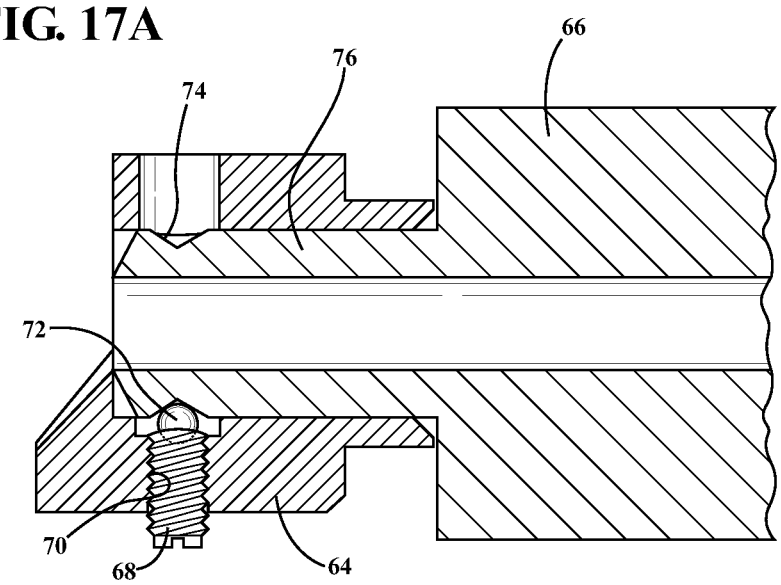

CHAMBER INSERT LOCK INSTALLED WITHIN AN AR-15/16 BARREL EXTENSION FOR LOCATING AND REDUCING MOVEMENT OF AN ASSOCIATED SUB CALIBER ACTION

CROSS-REFERENCE TO RELATED APPLICATIONS

This Application claims the benefit of U.S. Provisional Application 61/328,765 filed on Apr. 28, 2010.

FIELD OF THE INVENTION

The present invention discloses an upper receiver installable sub caliber action device including a modified bolt assembly incorporating a forward positioned and seating chamber insert for use with such as an AR-15/M16 type firearm. The chamber insert exhibits radially projecting lugs which seat within interiorly communicating grooves established in the barrel extension in order to remove any degree of looseness or play of the action. A further variant of the chamber insert lock is configured to fit within a dedicated sub caliber action and essentially acts as a link between the collar and barrel associated with a standard AR16/M16 extension. A yet further variant discloses a sub-caliber action secured to an upper receiver barrel by a spring loaded ball detent locking within a groove extending around a circumference of such as a dedicated .22 barrel.

BACKGROUND OF THE INVENTION

Modification of an exiting AR-15/M16 type firearm, such as in order to accept a sub caliber action, often results in the associated chamber insert adaptor exhibiting an incremental amount of inter movement or play with respect to the barrel extension of the firearm upper receiver. Such movement has been found to impede performance of the firearm assembly during loading and extracting of cartridges.

SUMMARY OF THE INVENTION

The present invention teaches an insert locking mechanism incorporated into a sub caliber action device, installable within an upper receiver of an AR-15 type firearm, and which interfaces with an upper receiver mounted forward assist for use with such as .22 caliber ammunition and in order to eliminate movement or play of the chamber insert adaptor associated with the substituted sub caliber action. The mechanism includes a generally cylindrical shaped body supported upon the action and exhibiting a plurality of radially projecting and circumferentially extending lugs which are configured to mate and seat within a plurality of grooves circumferentially arrayed within a barrel defined in the upper receiver.

The body further exhibits such as a single rearward positioned and further outwardly projecting lever type feature which is rotated downwardly to seat against a location of the upper receiver. The action further includes a generally elongated receiver plate exhibiting a generally lengthwise extending notched interior established between extending sides, the notched interior seating a bolt and a forward assist adaptor in reciprocating fashion along the receiver plate between an end-most location and a forward secured chamber adaptor. Additional features include the cylindrical shaped body being supported forward of the bolt in seating fashion upon the chamber adaptor.

The bolt further exhibits a rearward projecting support sleeve including an open interior for receiving and seating an opposing guide rod associated with a further mounting location of the receiver plate and in order to maintain in assembled fashion the forward assist adaptor. The forward assist adaptor further exhibits a generally semi-circular cross sectional shape with a plurality of scales along an extending side in communication with a forward engaging pawl of the forward assist. An additional variant includes sub-caliber action secured to an upper receiver barrel by a spring loaded ball detent locking within a groove extending around a circumference of such as a dedicated .22 barrel.

BRIEF DESCRIPTION OF THE DRAWINGS

Reference will now be made to the attached drawings, when read in combination with the following detailed description, wherein like reference numerals refer to like parts throughout the several views, and in which:

FIG. 8 is an illustrative perspective of partial upper and lower receiver components in an pre-assembled condition with the sub-caliber action pre-installed within the upper receiver;

FIG. 9 is a similar illustration to FIG. 8 in which the sub caliber action is depicted without the upper receiver;

FIGS. 12-16 depict a series of perspective exploded and assembled views of a further variant of chamber insert lock incorporated into a dedicated sub caliber action according to the present inventions;

FIG. 17 is an exploded view of a further variant of sub-caliber action secured to an upper receiver barrel by a spring loaded ball detent locking within a groove extending around a circumference of such as a dedicated .22 barrel;

FIG. 17A is an assembled and side cutaway view of the assembly shown in FIG. 17.

DETAILED DESCRIPTION OF THE PREFERRED EMBODIMENTS

Referring now to the following illustrations, the present invention discloses an upper receiver installable sub caliber action device including a modified bolt assembly incorporating a forward positioned and seating chamber insert for use with such as an AR-15/M16 type firearm. The chamber insert exhibits radially projecting lugs which seat within interiorly communicating grooves established in the barrel extension in order to remove any degree of looseness or play of the action.

Figure 1:
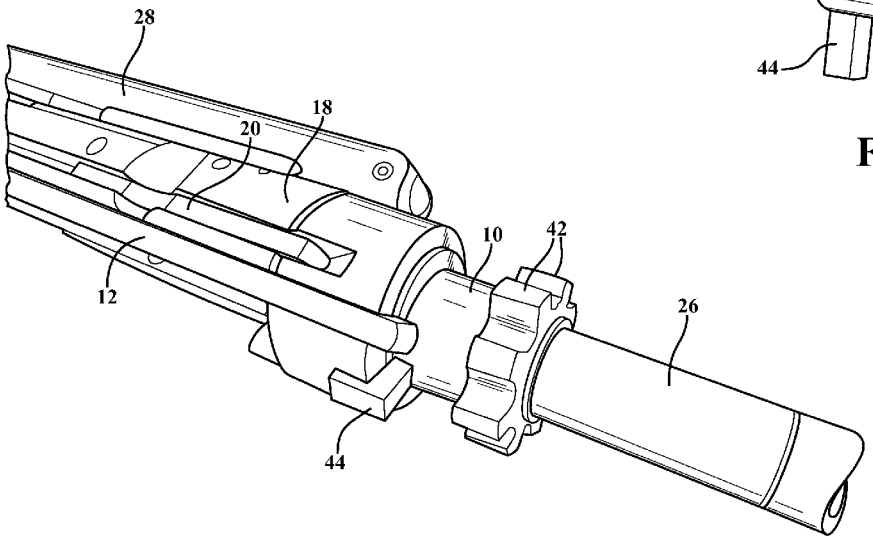
FIG. 1 is an illustration of the chamber insert lock incorporated into a sub caliber action according to the present invention.
Figure 2:
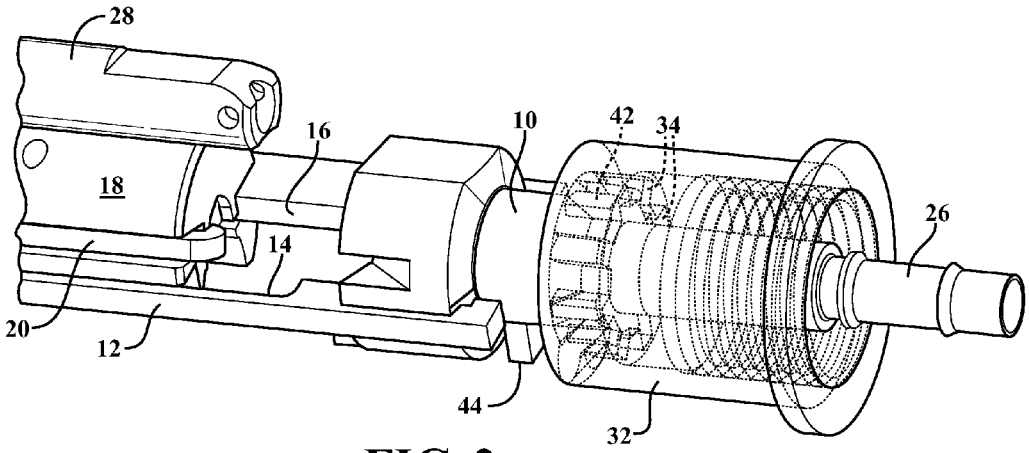
FIG. 2 is a similar illustration to FIG. 1 in which the cycling bolt is depicted in a rearwardly displaced condition upon the associated fixed receiver plate and the insert lugs are depicted a pre-seated distance from an illustrated portion of the upper receiver depicting aligning barrel extension grooves.

Referencing throughout the various drawings, and with initial reference to FIG. 1, illustrated at 10 is a generally cylindrical shaped main body of a chamber insert lock incorporated into a sub caliber action according to the present invention. The sub caliber action is illustrated throughout the drawings and includes generally elongated receiver plate is shown at 12 and exhibits a generally lengthwise extending notched or keyed interior, established between generally parallel extending sides 14 and 16 (see as best shown in FIG. 2 and which also depicts inwardly facing protrusions established along the inwardly facing and extending sides defining the notch for locating and seating the various adapter and bolt components).

The notched interior of the receiver plate 12 is configured for seating the remaining components of the modified bolt assembly in a generally stacked and assembly fashion. Among these are included each of a reciprocating bolt subassembly 18 with side disposed extractor 20, a forward assist adapter 22, see in particular FIGS. 5 and 9, which is seated behind the bolt 18 and exhibits side disposed scales or edges 23 for selectively being engaged by a forward assist plunger 24, and a forward-most projecting fixed chamber adaptor 26.

In this fashion, the forward assist sub caliber action device is mounted within the upper receiver portion of the AR-15 type firearm (see FIG. 8 et seq.) and exhibits a forward most engagement feature for contacting a specified ridge or scale 23 of the adaptor component 22. In use, the forward assist plunger 24 is used to manually close the sub caliber action and is, in this sense an "emergency" feature in that, such as in instances where the chamber gets dirty and/or if the action spring is a little older and less springy, the bolt may fail to close all the way.

As further depicted, the forward assist pushes on a selected location established along the plurality of side disposed ridges or scales 23 exhibited on the forward assist adaptor 22, these again termed "fish scales" which are exhibited on the side of the bolt carrier for enabling the bolt to be fully pushed into the forward located chamber adaptor. As is further illustrated, the forward assist plunger 24 on the upper receiver is manipulated via a push button configuration found commonly on M16 and AR-15 styled rifles, and usually located near the bolt closure such that, when depressed, the plunger will push the bolt carrier forward, ensuring that the bolt is locked. The forward assist can also be used to close a bolt that was gently let down, rather than released under full spring compression, such as in order to keep the noise of closing the bolt to a minimum. For purposes of the present invention, it should be understood that the forward assist adaptor 22 is an optional component for purposes of the variant depicted in FIG. 5, with the further understanding that inset locking component 10 can be incorporated into any sub caliber action device which may or may not incorporate forward assist functionality.

The configuration of the bolt assembly 18 is further such that a rearward projecting support sleeve 28 includes an open interior for receiving and seating an opposing guide rod 30 (again FIGS. 5 and 9) associated with a further mounting location of the receiver plate 12 and in order to maintain in assembled fashion the adaptor bolt subassembly 18 (such as is known as a .22 caliber adaptor bolt). Although not shown, a main action coil spring is positioned between the sleeve 28 and rod 30 to bias the bolt relative the receiver plate.

As is known, the bolt assembly is a mechanical part of the firearm upper receiver and which is seated within a barrel at a location in which it blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards) via a forward extending gas port and an upper and rear extending/rerouting of a gas tube for utilizing the gas blowback to successively eject and reload (re-chamber) a succeeding round.

Upon moving back, the bolt pushes the cartridge (not shown) from an attached magazine (also not shown) and pushes it into a firearm chamber established between the upper and lower assembled receivers. Upon successive discharge, and once the spent shell casing case is clear of the chamber, an ejector component of the bolt ejects the casing from the receiver and out of the firearm (such as through a side window of the upper receiver which exposes the firing chamber.

Figure 10:
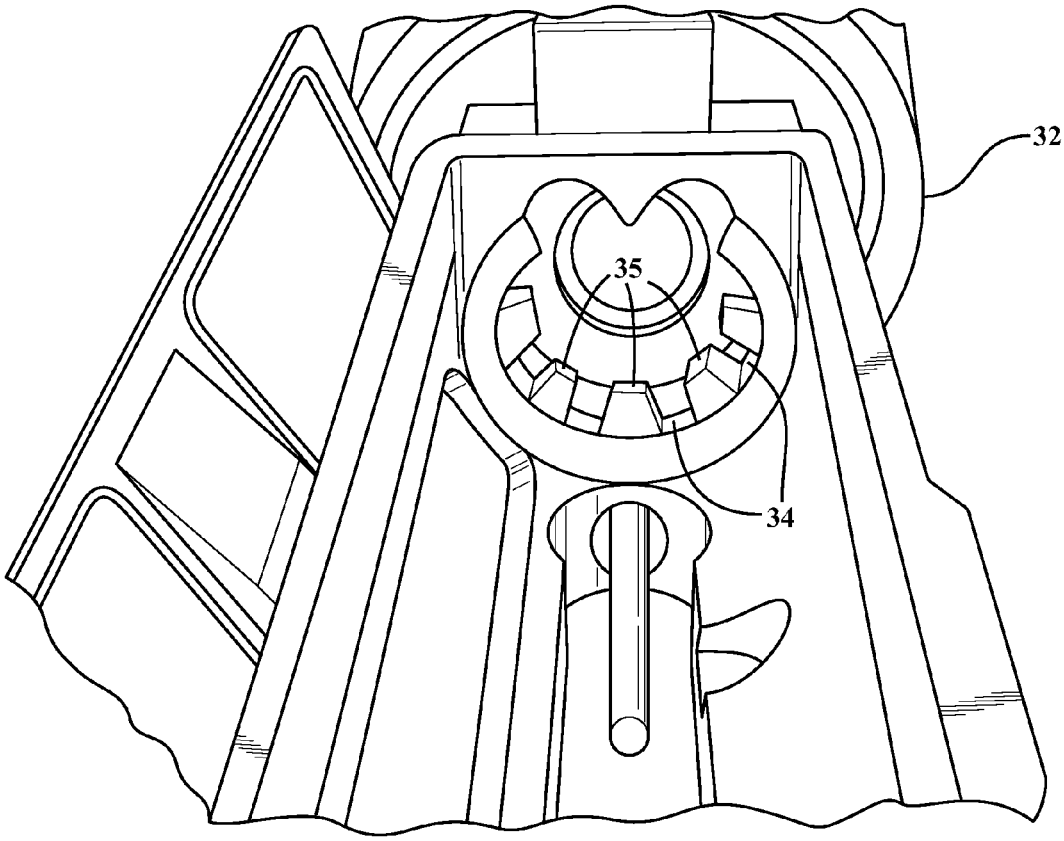
FIG. 10 is an enlarged linear perspective of the upper receiver underside and depicting the barrel extension grooves which seat the chamber insert lugs.

As is further known, the assembled sub caliber action is inserted within a rear open end of an associated upper receiver portion (see as partially depicted at 32 in FIGS. 8 and 10) of the AR-15 firearm. Without further elaboration, additional existing and interfacing features associated with the upper receiver include an underside accessible aperture (see as again shown in FIG. 10) defined in a lengthwise configured barrel portion (and which further exhibits a circumferentially spaced plurality of radially configured and alternating ramps and recessed grooves, as depicted by grooves 34 separated by an alternating plurality of ramps 35), the upper receiver 32 being secured upon an associated lower receiver 36 (see FIGS. 8 and 9) and communicating magazine and which, upon installation, is in communication with the reciprocating bolt subassembly 10.

Figure 11:
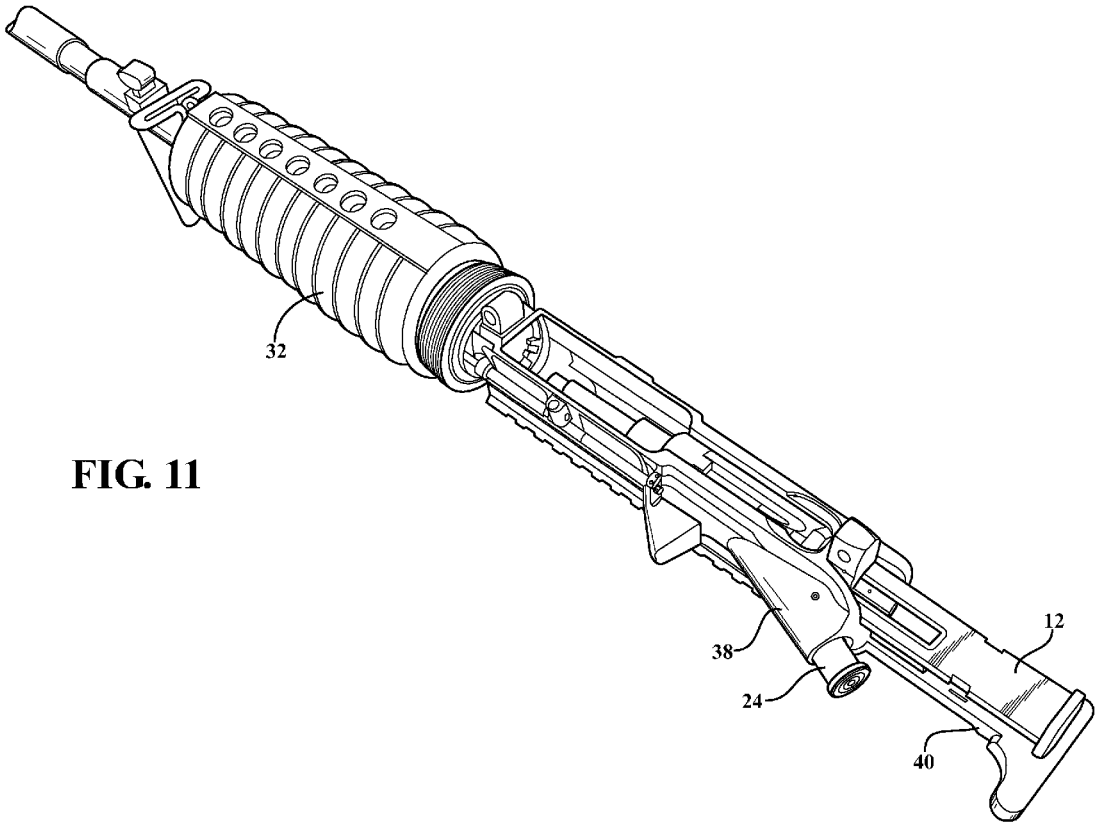
FIG. 11 is a further overall view of an upper receiver and further depicting in partially removed fashion a rear installing charging handle in combination with the sub caliber action.
Figure 12:
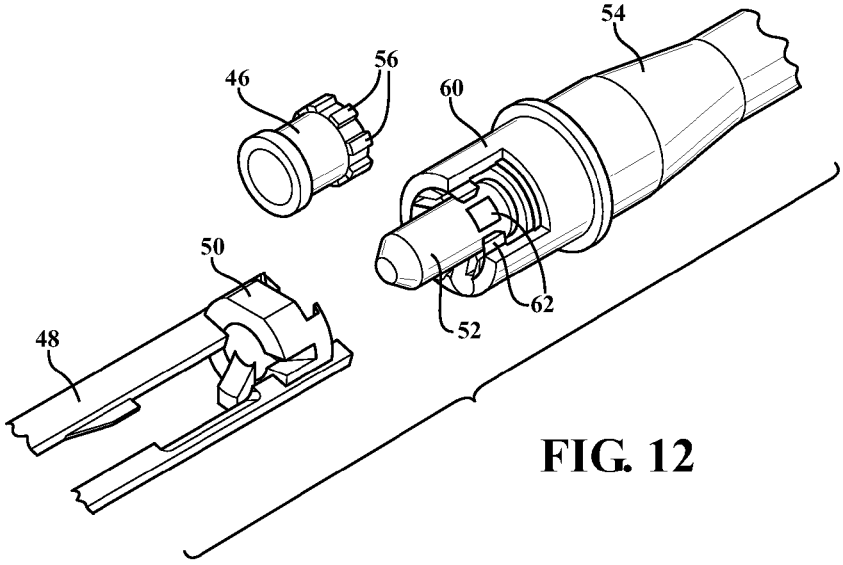
Figure 13:
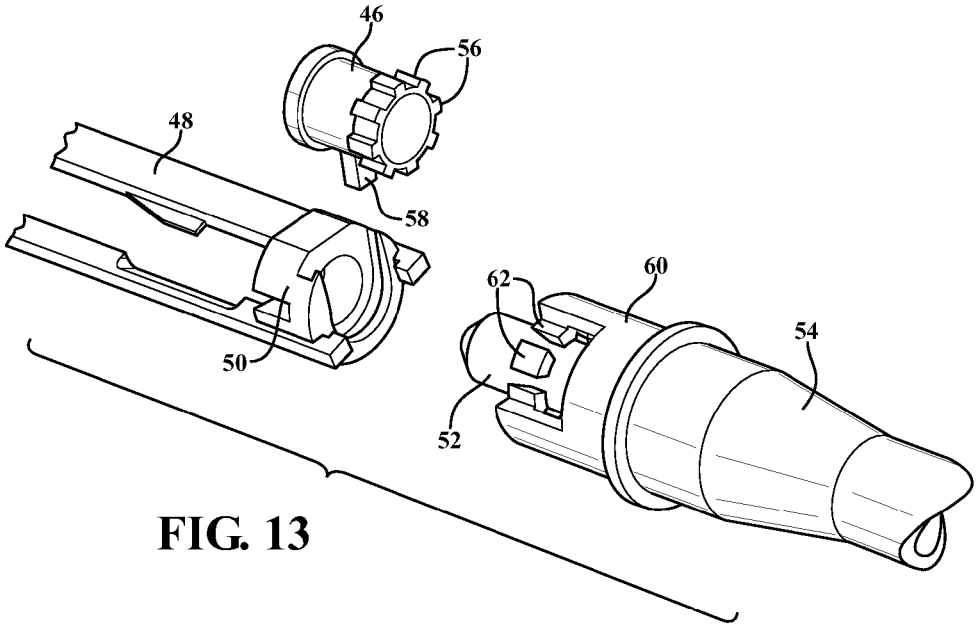

Additional existing features of the upper receiver 32 include the provision of a forward assist housing 38 (FIG. 8) mounted in angularly extending and integrated fashion into a rear housing location of the upper receiver 34 and which seats the forward assist plunger 24. A charging handle 40 (see FIG. 11) is installed within an open rear of the barrel portion of the upper receiver 32 and which assists in seating, supporting and removing of the sub caliber action within the upper receiver 32.

Figure 4:
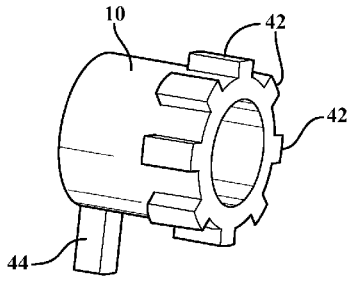
FIG. 4 is a sectional illustration of the chamber insert with locking feature dismounted from the sub caliber action.

As best depicted in the sectional illustration of FIG. 4, the chamber insert 10 with locking feature is shown dismounted from its otherwise installed position upon the sub caliber action, and in particular upon the forward projecting chamber adaptor 26. The generally cylindrical shaped insert 10 is constructed of an appropriate metallic composition (such as without limitation including a brass construction) and exhibits a plurality of forward positioned, radially projecting and circumferentially arrayed lugs 42, each of which exhibits a specified depth which, as will be further described, is intended to align with and nest or seat within the barrel extension grooves 34 (again FIG. 10) associated with communicating inner barrel end of the upper receiver 32. As shown, the insert 10 also depicts a single rearward positioned and further outwardly/downwardly projecting lever type feature 44

FIG. 2 is a similar illustration to that depicted in FIG. 1 and illustrates the reciprocating (or cycling) bolt 18 in a rearwardly displaced condition relative the associated receiver plate and in which the circumferentially arrayed insert lugs 42 are depicted a pre-seated distance from an illustrated portion of the upper receiver depicting aligning barrel extension 34 grooves. Proceeding to FIG. 3, a succeeding illustration depicts the insert lugs 42 seated within the barrel receiver grooves 34 (see again in phantom) in a most forward displaced condition of the sub caliber action and associated with the insert 10 seated flush within the barrel receiver location depicted in FIG. 10, and with the forward most chamber adaptor 26 extending through the barrel portion of the upper receiver 32 in the manner shown in FIG. 3.

Figure 3:
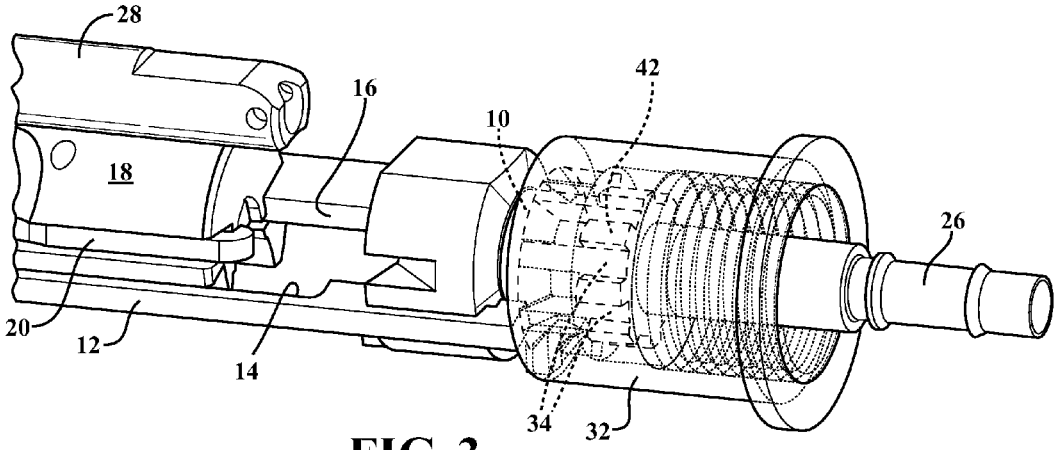
FIG. 3 is a succeeding illustration to FIG. 2 in which the insert lugs seat within the barrel receiver grooves in a most forward displaced condition of the sub caliber action.
Figure 5:
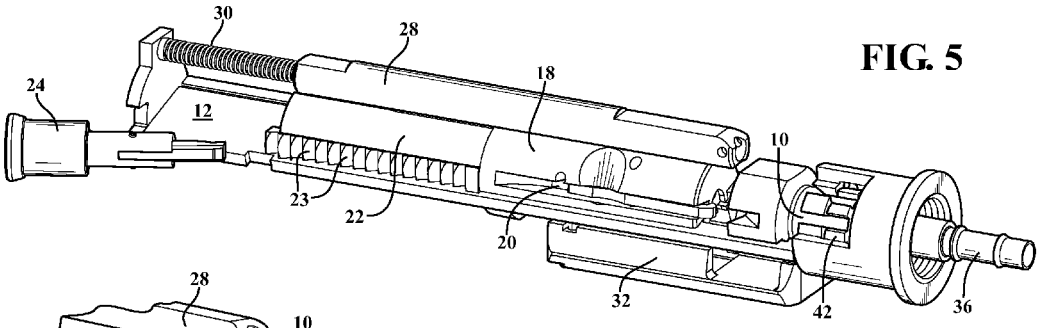
FIG. 5 is an overall perspective view of the sub caliber action as generally depicted in FIG. 3 illustrating the full length of the receiver plate and rear engaging forward assist, and which depicts the barrel receiver in solid with partial cutaway within which the insert lugs are locked.
Figure 6:
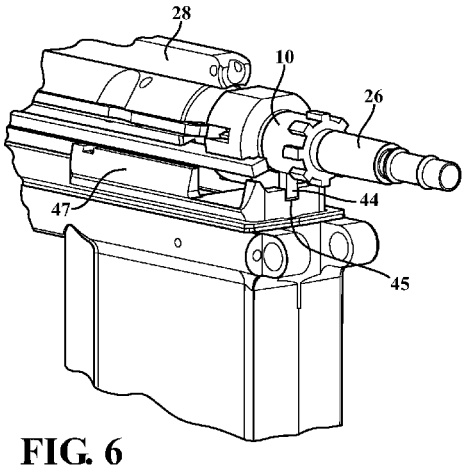
FIG. 6 is a further cutaway view illustrating a projecting arm associated with the insert rotated to a downward (6 o'clock) seating position against receiver housing.

Proceeding to FIG. 5, an overall perspective view of the sub caliber action as generally depicted in FIG. 3 illustrates the full length of the receiver plate 12 and rear engaging forward assist 24, and which further depicts a portion of the upper (barrel) receiver 32 in solid with partial cutaway within which the circumferentially arrayed lugs 42 of the insert 10 are locked. FIG. 6 is a further cutaway view illustrating the projecting lever 44 associated with the insert 10 which is rotated to a downward (6 o'clock) seating position relative to an inner notched location 45 of a bolt hold open actuator subassembly 47 incorporated into the upper receiver housing to prevent the insert/lock 10 from coming undone when the rifle is discharged.

Figure 7A:
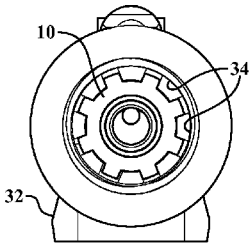
FIGS. 7A-B illustrate end views of FIG. 5 in which insert is illustrated in pre-spaced and post displaced and rotated/locked positions relative to the housing.
Figure 7B:
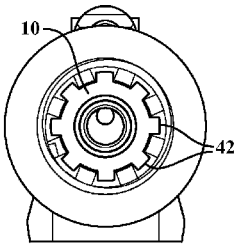

FIGS. 7A-B illustrate a pair of end views of FIG. 5 in which the insert 10 is illustrated in respective pre-spaced and post displaced and rotated/locked positions relative to the alternating grooves 34 associated with the upper receiver housing 32. FIG. 8 further provides an illustrative perspective of partially depicted upper 32 and lower 36 receiver components in an pre-assembled condition with the sub-caliber action pre-installed within the upper receiver 32 and FIG. 9 a similar illustration to FIG. 8 in which the sub caliber action is depicted without the upper receiver.

In this fashion, the chamber insert 10 fits within the upper receiver barrel and is secured by the overall length fit established by the sub caliber action (see again mounting location upon which the insert 10 seats at a base of the forward projecting chamber adaptor 26). In this manner, any extra space is occupied by the insert 10 and further so that the action receiver 12 (upon which the bolt 18 is repetitively cycled) is maintained without any degree of looseness or play. As a result, an optimal degree of performance is realized during loading and extracting motion of the bolt 18 during each cartridge cycle.

Referring to FIGS. 12-16, depicted are a series of perspective exploded and assembled views of a further variant of chamber insert lock, generally illustrated at 46 (as compared to that shown at 10 in FIG. 1) and incorporated into a dedicated sub caliber action (further referenced by receiver plate 48). The receiver plate 48 is shown without the bolt and further illustrates, at a forward end, an end support 50 for seatingly receiving the insert lock 46 in assembled fashion along with an inner extension portion 52 of associated upper receiver barrel 54.

As with the insert previously described at 10, the dedicated insert 46 exhibits a plurality of radially projecting and circumferentially arrayed lugs 56 at a forward end combined with a single rearward positioned and downwardly projecting feature 58. The barrel 54 further includes an inner nut 60, within which is interiorly formed a plurality of inner groove defining and circumferentially spaced ramp projections 62 (compared to the inner ramps and grooves 34 in FIG. 10) which, upon assembly of the dedicated receiver, align and offset with radially projecting lugs 56 of the dedicated insert 46.

FIG. 14 illustrates a pre-assembled position of the dedicated insert 46 located upon the end located support 50 and prior to inserting of the inner supported extension 52 of the barrel 54. Proceeding to FIG. 15, an initial installation position is shown in which the barrel 54 is assembled and the inner disposed and groove defining ramp projections 62 align with and seat past the spaces defined between the circumferentially spaced lugs 56. With reference to FIG. 16, the dedicated insert 46 is rotated to align the lugs 56 behind the upper extending ramped edges of the projections 62 defined in the inner barrel nut 60.

Referring now to FIG. 17, an exploded view is shown of a further variant of a sub-caliber action 64 (again termed as a type of chamber lock defining a forward mounted component of the receiver plate and for removing inter-movement or play between the forward most mounted chamber adaptor (such as at 26) and the upper receiver barrel 66. In this variant, the chamber lock exhibits a generally barrel or collar shaped body (again at 64. A spring loaded ball detent is arranged upon an inserting end of an engagement body, see at 68 as best shown in FIG. 17A, and which is pressed into a sleeve or aperture 70 within the action (or lock) body 64.

The body 68 exhibits a generally elongated and three dimensional shape and integrates a spring (not shown) which displaces an end supported ball detent, further shown at 72. The body 68 is press fit within the aperture 70 so that the ball detent engages as shown, however it is further understood that alternative variants can also incorporate a threaded engagement established between the detent body and the inner radially extending aperture in communication with the inserting barrel 66. In this fashion, the ball 72 is biased in an inwardly and engaging fashion within a recessed (typically "V" shaped) groove 74 extending around a circumference of an inserting neck 76 of the barrel 66 (such as a dedicated .22 barrel), the detent 72 further capable of being physically disengaged from the barrel 66 by exerting a reverse pulling force to separate from the annular groove 74 or by otherwise modifying the detent to retract from the groove in a static position.

Figure 17B:
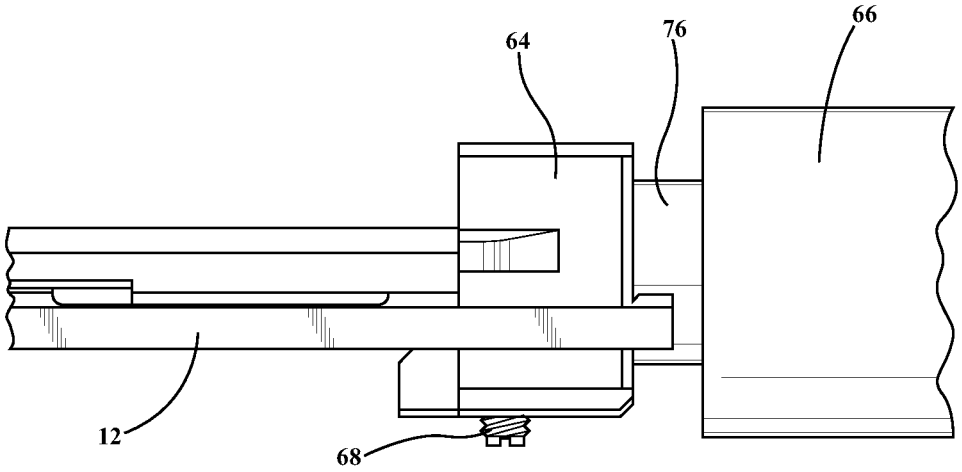
FIG. 17B is a further side plan view of the assembly in FIG. 17A in partial cutaway and depicting a portion of the bolt to forward chamber adaptor interface.

As further shown in FIG. 17A, the sub-caliber action 64 exhibits a generally barrel collar shape which encircles an inserting annular neck portion 76 of the barrel 66. FIG. 17B is a further right side plan view of the assembly in FIG. 17A, in partial cutaway, and depicting a portion of the bolt 68 to forward chamber adaptor interface also including the receiver plate 12.

Having described my invention, other and additional preferred embodiments will become apparent to those skilled in the art to which it pertains, and without deviating from the scope of the appended claims.

We claim:

1. An insert locking mechanism incorporated into a sub caliber action device installable within an upper receiver of an AR-15 type firearm for use with at least .22 caliber ammunition, the action device including an elongated receiver plate seating a reciprocating bolt, said mechanism comprising:

a generally cylindrical shaped body which is both supported upon and situated around a chamber adapter mounted to a forward end of the receiver plate and projecting forwardly from the bolt, a plurality of radially projecting and circumferentially extending lugs positioned around a forward end of said cylindrical shaped body which are configured to mate and seat within a plurality of grooves circumferentially arrayed within a configured inner end of a barrel portion of the upper receiver.

2. The mechanism as described in claim 1, said body further comprising a rearward positioned and outwardly projecting lever which seats within a notch associated with a bolt hold open subassembly incorporated into the upper receiver.

3. The mechanism as described in claim 1, receiver plate exhibiting a generally lengthwise extending notched interior established between extending sides, said notched interior seating a bolt and a forward assist adaptor in reciprocating fashion along said receiver plate between an end-most location and a forward secured chamber adaptor.

4. The mechanism as described in claim 3, said bolt further comprising a rearward projecting support sleeve including an open interior for receiving and seating an opposing guide rod associated with a further mounting location of said receiver plate and in order to maintain in assembled fashion said forward assist adaptor.

5. The mechanism as described in claim 3, said forward assist adaptor further comprising a generally semi-circular cross sectional shape with a plurality of scales along an extending side in communication with a forward engaging pawl of the forward assist.

6. An action device for use with an upper receiver of an AR-15 type firearm for facilitating use with of a sub caliber ammunition, comprising:

a generally elongated receiver plate seating a reciprocating bolt;

said receiver plate further including a chamber insert lock mounted forwardly of said reciprocating bolt, said insert lock exhibiting a cylindrical shaped main body which is both supported upon and situated around a chamber adapter mounted to a forward end of said receiver plate and projecting forwardly from said bolt;

said upper receiver including a barrel with a configured inner end within which seats a forward-most portion of said chamber insert lock upon installation of said action device within said upper receiver to remove any looseness between said action device and said upper receiver.

7. The action device as described in claim 6, said insert lock further comprising a plurality of radially projecting and circumferentially extending lugs around a forward end of said cylindrical shaped body which are configured so as to be adapted to mate and seat within a plurality of grooves circumferentially arrayed within the configured inner end of the barrel.

8. The action device as described in claim 7, said body further comprising a rearward positioned and outwardly projecting lever which seats within a notch associated with a bolt hold open subassembly incorporated into the upper receiver.

9. The action device as described in claim 6, further comprising a forward assist adaptor positioned rearwardly of said bolt upon said receiver plate in likewise reciprocating fashion.

10. The action device as described in claim 9, said bolt further comprising a rearward projecting support sleeve including an open interior for receiving and seating an opposing guide rod associated with a further mounting location of said receiver plate and in order to maintain in assembled fashion said forward assist adaptor.

11. The action device as described in claim 10, said forward assist adaptor further comprising a generally semi-circular cross sectional shape with a plurality of scales along an extending side in communication with a forward engaging pawl of the forward assist.

12. The action device as described in claim 6, a barrel associated with the upper receiver exhibiting an annular extending neck upon which is exhibited a recessed annular groove, an elongated detent installed within a radially extending aperture defined in said body and accessible with an open interior such that, upon positioning inserting said annular neck within said body, said detent engages within said groove.

13. The action device as described in claim 12, said detent further comprising an internally positioned spring which influences an end supported ball in engagement with said barrel groove.

* * * * *